US007540392B2

(12) United States Patent
Cipra et al.

(10) Patent No.: US 7,540,392 B2
(45) Date of Patent: Jun. 2, 2009

(54) PERMEABLE CONTAINMENT APPARATUS FOR A RECEPTACLE

(76) Inventors: Keith Anthony Cipra, 3101 Andrea Ct., Woodridge, IL (US) 60517; Marion Cipra, 3101 Andrea Ct., Woodridge, IL (US) 60517

( * ) Notice: Subject to any disclaimer, the term of this patent is extended or adjusted under 35 U.S.C. 154(b) by 671 days.

(21) Appl. No.: 11/295,108

(22) Filed: Dec. 5, 2005

(65) Prior Publication Data

US 2007/0125676 A1 Jun. 7, 2007

(51) Int. Cl.
*B65D 51/16* (2006.01)
*B65D 51/18* (2006.01)
*B65D 45/32* (2006.01)

(52) U.S. Cl. ..... 220/254.3; 220/287; 220/319; 220/370

(58) Field of Classification Search ..... 220/371, 220/370, 367.1, 254.3, 287, 319
See application file for complete search history.

(56) References Cited

U.S. PATENT DOCUMENTS 3,797,693 A * 3/1974 Baker ..... 220/370
3,807,596 A * 4/1974 Baker ..... 220/369
4,315,579 A * 2/1982 Martin, Jr. ..... 220/371
4,532,722 A * 8/1985 Sax ..... 34/60
4,747,392 A * 5/1988 Rogers ..... 126/299 C
5,066,597 A * 11/1991 Stinson et al. ..... 435/300.1
5,117,999 A * 6/1992 Canzano et al. ..... 220/203.17
5,601,199 A * 2/1997 Marty ..... 215/11.1
5,759,241 A * 6/1998 Klett et al. ..... 96/134
5,794,539 A * 8/1998 Ott et al. ..... 105/377.08
5,988,426 A * 11/1999 Stern ..... 220/371
6,056,146 A * 5/2000 Varakian et al. ..... 220/370
6,056,147 A 5/2000 Jarman
6,059,458 A 5/2000 Belias et al.
6,139,185 A 10/2000 Hamilton et al.
6,230,914 B1 * 5/2001 Wang ..... 217/56
6,352,166 B1 * 3/2002 Copeland ..... 220/254.2
6,578,726 B1 * 6/2003 Schaefer ..... 220/253
D562,589 S * 2/2008 Mellon et al. ..... D6/449
2002/0195450 A1 * 12/2002 Ferguson ..... 220/367.1
2003/0226846 A1 * 12/2003 Horwath ..... 220/287
2005/0000963 A1 * 1/2005 Cautereels et al. ..... 220/254.1
2006/0043093 A1 * 3/2006 Cox et al. ..... 220/371

* cited by examiner

*Primary Examiner*—Anthony D Stashick
*Assistant Examiner*—Niki M Eloshway
(74) *Attorney, Agent, or Firm*—Steven A. Maynard; Conduit Technology Partners

(57) ABSTRACT

The present invention provides a permeable containment apparatus for a receptacle having a vertical containment wall, an open end, and an upper wall region terminating at a peripheral edge, including a securing portion having an annular biasing mechanism adapted to maintain said securing portion in contacting relationship with the upper wall region of said receptacle, a substantially permeable cover portion attached to said securing portion and covering the open end of said receptacle, and wherein said permeable cover portion is adapted to contain receptacle content while allowing for substantial aeration of said receptacle.

4 Claims, 5 Drawing Sheets

PERMEABLE CONTAINMENT APPARATUS FOR A RECEPTACLE

This Application repeats a substantial portion of prior application Ser. No. 11/295,108, filed Dec. 5, 2005. The present Application incorporates said Application by reference and contains no new matter.

FIELD OF THE INVENTION

The present invention relates to a receptacle containment system, and more specifically, a permeable containment apparatus for a receptacle.

BACKGROUND OF THE INVENTION

Receptacle containers are typically used for holding refuse until it can be collected, and for holding recyclable products until they can be delivered to an appropriate recycling facility. Such containers are widely used in neighborhoods for home refuse and recyclables, in businesses for waste and used paper products, in restaurants for waste and recyclable food product, as well as in recreational areas, industrial areas, and commercial areas for various types of waste.

While these receptacles serve well the purpose of holding such waste and recyclables, there is a list of problems with using such containers. Open ended recycling and trash receptacles allow for lightweight items such as plastic, cardboard, and paper to be blown out of the receptacles. This results in said refuse to be blown into the community, thereby polluting yards, streets, and alleyways. In the cases where traditional non-permeable lids are available, they typically get lost, discarded, and are often not used by recycling and trash collection operators. When the non-permeable lids are used, bacteria growth and rancid odors ensue, creating poor public health conditions. Regrettably, the list continues, however, it is clear that current receptacle containment systems fall short of sufficiently resolving a plethora of waste and recyclable product management problems.

It is therefore desired to have a permeable closure apparatus that prevents the pollution of our communities while at the same time allows aeration, thereby minimizing bacteria and odor proliferation.

SUMMARY OF THE INVENTION

It is an object of the present invention to provide a permeable containment apparatus for a receptacle that overcomes the disadvantages of the prior art.

Accordingly, the present invention advantageously provides a permeable containment apparatus for a receptacle having a vertical containment wall, an open end, and an upper wall region terminating at a peripheral edge, including a securing portion having an annular biasing mechanism adapted to maintain said securing portion in contacting relationship with the upper wall region of said receptacle, a substantially permeable cover portion attached to said securing portion and covering the open end of said receptacle, and wherein said permeable cover portion is adapted to contain receptacle content while allowing for substantial aeration of said receptacle.

It is a feature of the present invention that the permeable containment apparatus for a receptacle includes a receptacle attachment device operatively connected to at least one of said securing portion or said permeable cover portion.

BRIEF DESCRIPTION OF THE DRAWINGS

These and other objects, advantages, and features of the present invention will become apparent from a reading of the following detailed description with reference to the accompanying drawings, in which.

DESCRIPTION OF THE PREFERRED EMBODIMENT(S)

Figure 1:
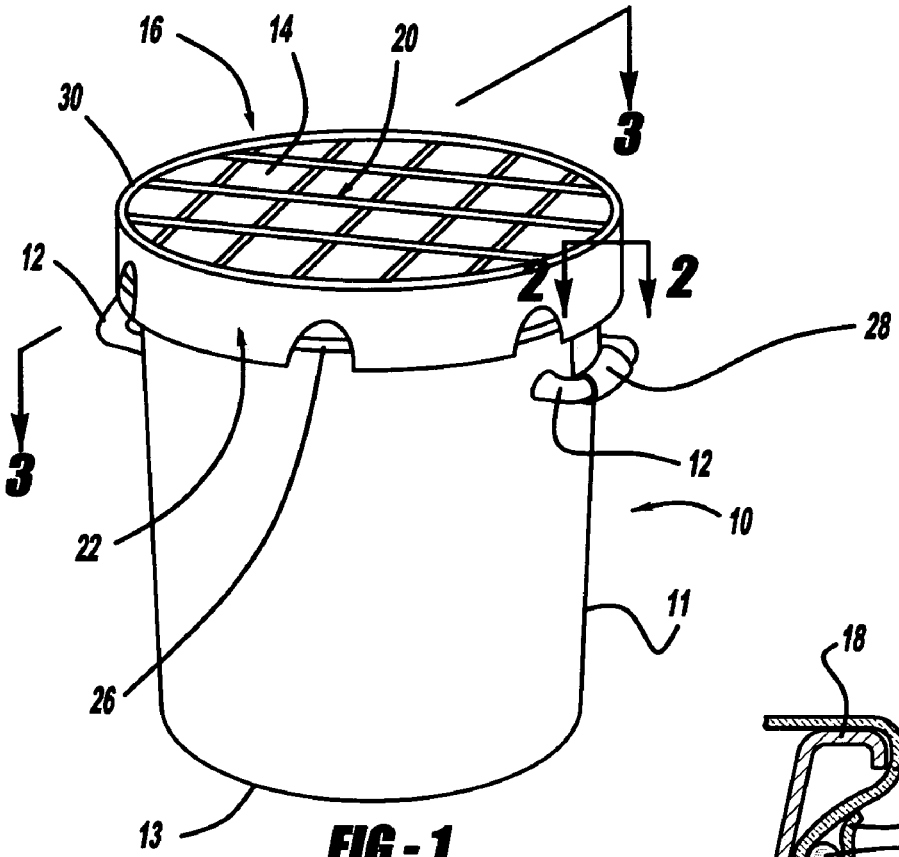
FIG. 1 is a perspective view of a permeable containment apparatus for a receptacle according to the present invention.
Figure 3:
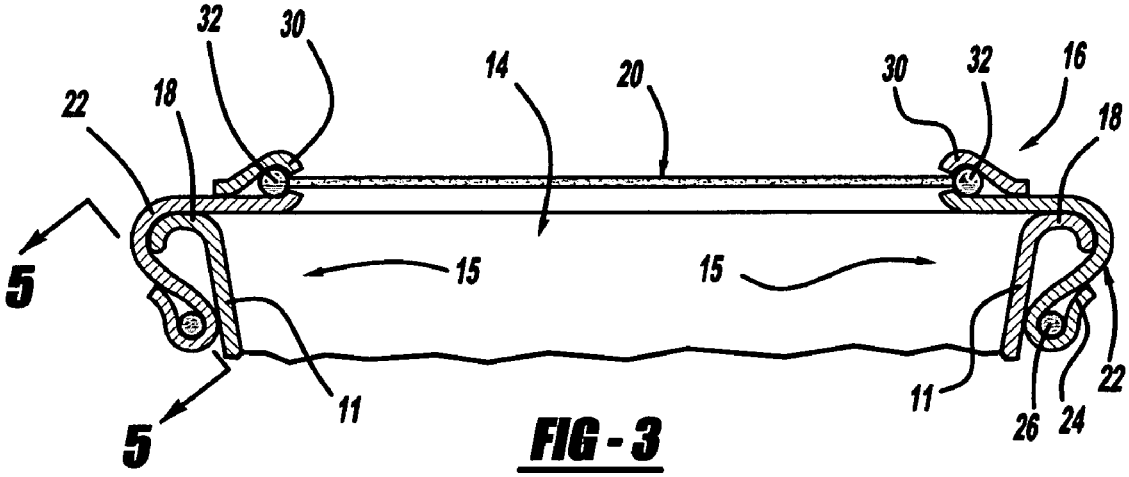
FIG. 3 is a cross-sectional view taken along line 3-3 of FIG. 1 detailing a securing portion of the permeable containment apparatus according to the present invention.

Referring to FIGS. 1 and 3, a trash receptacle 10 is shown. The receptacle 10 is typically circular in cross-section and cylindrical in form, but may also be substantially rectangular or square. The receptacle 10 has a substantially vertical containment wall 11 extending from an enclosed base end 13. The receptacle 10 often has handles 12, typically disposed on the containment wall 11, in order to move or lift the receptacle 10. The handles 12 extend a predetermined distance from the receptacle 10, and are a predetermined height on the receptacle 10. The receptacle 10 also has an open end 14 (See FIG. 4 also). The open end 14 is where refuse and recyclables are placed into the receptacle 10. The open end 14 extends a predetermined depth into the receptacle 10, such that the receptacle 10 has a predetermined waste or recyclable receiving capacity.

Also shown in FIGS. 1 and 3 is a permeable containment apparatus 16 for the open end 14 of the receptacle 10. This permeable containment apparatus 16 functions as a breathable lid, covering the open end 14 of the receptacle 10 adjacent the peripheral edge 18 of the receptacle 10. As such, the permeable containment apparatus 16 has a predetermined planar area substantially parallel to a peripheral edge 18 of said receptacle 10. In FIG. 1, the permeable containment apparatus 16 is substantially circular in order to fit the circular shape of the receptacle 10, but may also be adapted to fit a rectangular receptacle or a substantially square receptacle (As shown in FIG. 9). The permeable containment apparatus 16 has a cover portion 20, that substantially covers the open end 14 of the receptacle 10. This cover portion 20 of the permeable containment apparatus 16 preferably is a netting or mesh type permeable closure. The cover portion 20 may also be a breathable fabric, such as a gore-tex type material (See FIG. 8) or any other flexible and breathable type material as known in the arts.

Figure 2:
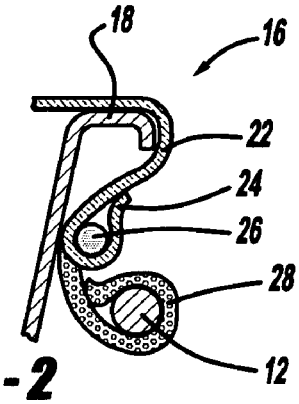
FIG. 2 is a cross-sectional view taken along line 2-2 of FIG. 1 detailing a receptacle attachment device of the permeable containment apparatus according to the present invention.

A closer look at how the permeable containment apparatus 16 fastens to the receptacle 10 can be seen in FIGS. 2 and 3, which are cross-sections taken along lines 2-2 and 3-3 of FIG. 1. The permeable containment apparatus 16 further has a securing portion 22 that secures the apparatus 16 to the receptacle 10. The securing portion 22 serves a girdling function and is made of a material such that it is strong enough to repeatedly secure the apparatus 16 to the receptacle 10 yet flexible enough that it can be removed and replaced back onto said receptacle 10 and is preferably comprised of a heavy duty nylon-type jacketing material as used in the outdoor camping industry, for example. The securing portion 22 of the permeable containment apparatus 16 extends over and down the peripheral edge 18 adjacent the vertical containment walls 11 of the receptacle 10 a predetermined length and extends the circumference of the permeable containment apparatus 16, thereby girdling the open end 14 about the peripheral edge 18. Preferably, a predetermined area of the securing portion 22 rests in adjacent and biased type retaining contact with an upper wall region 15 of the vertical containment walls 11.

Further, the securing portion 22 of the permeable containment apparatus 16 preferably terminates at a hem 24, which houses an annular biasing mechanism 26 in order to serve a retaining function. The annular biasing mechanism 26 preferably extends the entire circumference of the permeable containment apparatus 16 substantially adjacent the upper wall region 15 and at the hem 24. The annular biasing mechanism 26 is preferably made of flexible interwoven threads, like a bungee-type cord, or a rubber ring, or a resilient tubular restraint. Furthermore, an elongate metal or plastic spring would also mechanically serve as a biasing mechanism for the retaining function without departing from the scope of the biasing mechanisms as known in the arts. Essentially, the annular biasing mechanism 26 preferably has an elastic type resiliency sufficiently adapted such that the permeable containment apparatus 16 secures tightly to the receptacle 10 preferably substantially girdling said peripheral edge 18, yet can be repeatedly stretched to remove it from the receptacle 10.

Figure 4:
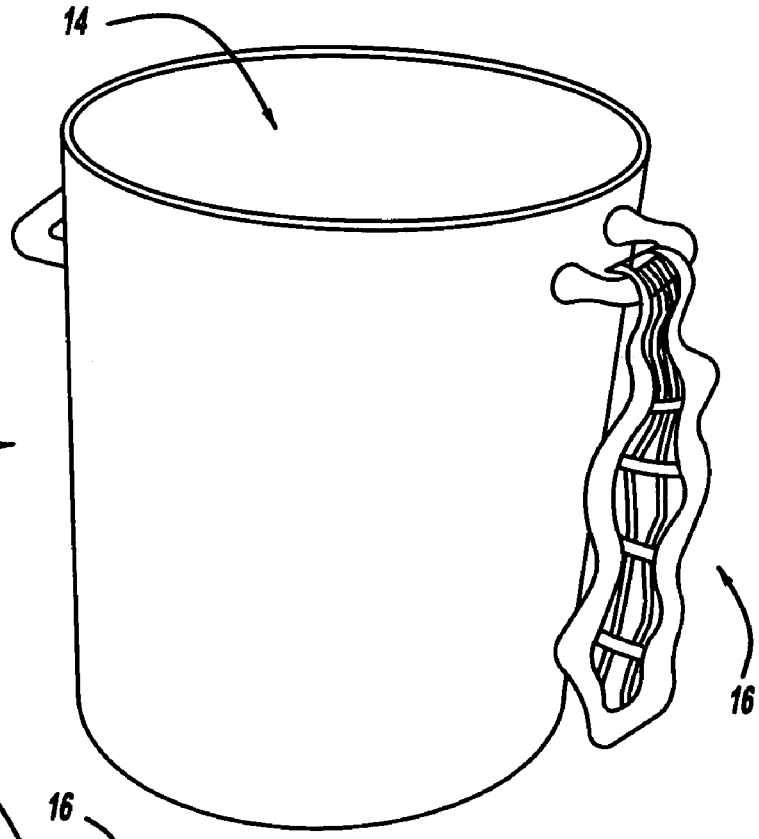
FIG. 4 is a perspective view of the permeable containment apparatus for a receptacle in an off position according to the present invention.

A feature of the permeable containment apparatus 16 is a receptacle attachment device 28 that secures the permeable containment apparatus 16 to the receptacle 10 when the permeable containment apparatus 16 is loosened to empty the contents of the receptacle 10 from its open end 14, as shown in FIG. 4. This ensures the permeable containment apparatus 16 will not be lost or discarded when the receptacle 10 is being emptied of its contents. Referring to FIG. 2, the receptacle attachment device 28 may extend from the first hem 24 of the securing portion 22 of the permeable containment apparatus 16. The receptacle attachment device 28 may be a handle wrap type releasable fastener, utilizing a hook and loop type fastener technology, or hooks or any device sufficiently adapted to attach the permeable containment apparatus 16 to the handle 12 of the receptacle 10. Furthermore, the receptacle attachment device 28 may be attached with simply a screw drilled through the securing portion 22 and directly into the vertical containment wall 11 of the receptacle 10, or any attachment device reasonably adapted to accomplish the function of not losing or discarding the apparatus 16 when emptying the receptacle 10 as known in the arts. The receptacle attachment device 28 may be fed down through the handle 12 of the receptacle 10 and brought up around the outside of the handle 12 of the receptacle 10 and be fastened to itself by means known and above mentioned, thus ensuring attachment of the permeable containment apparatus 16 to the receptacle 10 when the receptacle 10 is being emptied, as shown in FIG. 4.

Referring to FIG. 3, a closer look at the permeable containment apparatus 16 can be seen from a cross-section taken long line 3-3 of FIG. 1. Specifically, how the cover portion 20 and the securing portion 22 of the permeable containment apparatus 16 are connected is shown. The securing portion 22 has an edging 30 that extends a predetermined distance inward from the peripheral edge 18 of the receptacle 10 and extends the circumference of the securing portion 22. The edging 30 houses a net anchor 32. The net anchor 32 may be a knot or a bulb of the material that makes up the cover portion 20 (i.e., netting or breathable fabric) of the permeable containment apparatus 16, and is also the terminal end of the cover portion 20. Thus, the cover portion 20 and the securing portion 22 are operatively connected and the cover portion 20 substantially covers the open end 14 of the receptacle 10.

Figure 5A:
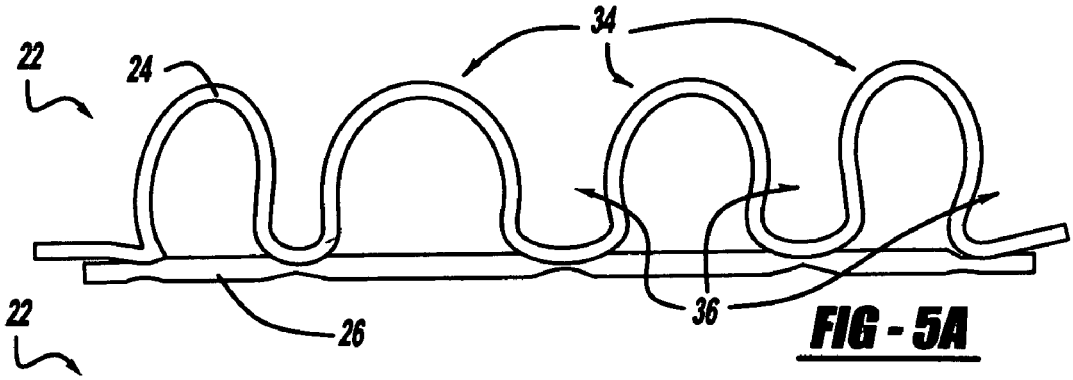
FIG. 5*a* is a cross-sectional view taken along line 5-5 of FIG. 3 detailing an annular biasing mechanism of the permeable containment apparatus for a receptacle in an off position according to the present invention.
Figure 5B:
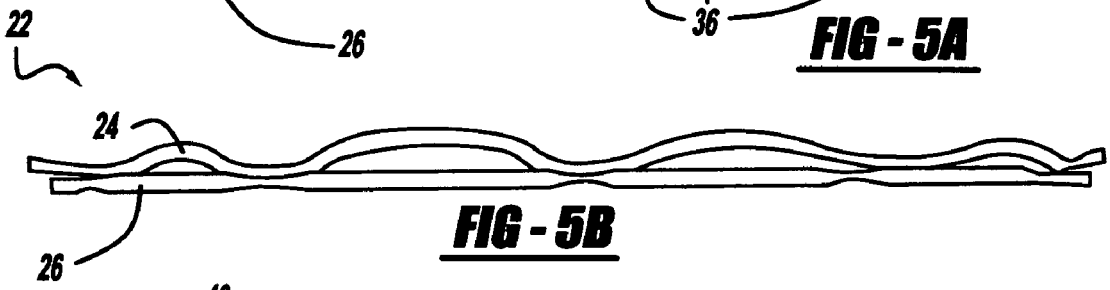
FIG. 5*b* is a cross-sectional view taken along line 5-5 of FIG. 3 detailing an annular biasing mechanism of the permeable containment apparatus for a receptacle in a secured on position according to the present invention.

Looking at FIG. 5*a* and FIG. 5*b*, a closer look is shown of the relationship between the annular biasing mechanism 26 and the hem 24 of the securing portion 22 of the permeable containment apparatus 16. FIGS. 5*a* and 5*b* are cross-sections taken along line 5-5 of FIG. 3. FIG. 5*a* shows the annular biasing mechanism 26 and the hem 24 of the permeable containment apparatus 16 when it is positioned such that it is off the open end 14 of the receptacle 10. As such, the hem 24 of the securing portion 22 of the permeable containment apparatus 16 is gathered in such a way that a plurality of loops are formed defined by a series of crests 34 and troughs 36.

FIG.

5*b* shows the annular biasing mechanism 26 and the hem 24 of the securing portion 22 of the permeable containment apparatus 16 when it is positioned such that it is covering the open end 14 of the receptacle 10. As such, the hem 24 of the securing portion 22 of the permeable containment apparatus 16 is substantially taut. Thus, its construction combines the elastic behavior of the annular biasing mechanism 26 with the durable characteristics of a heavy duty nylon sheath, as typically used in back pack construction.

In

Figure 6:
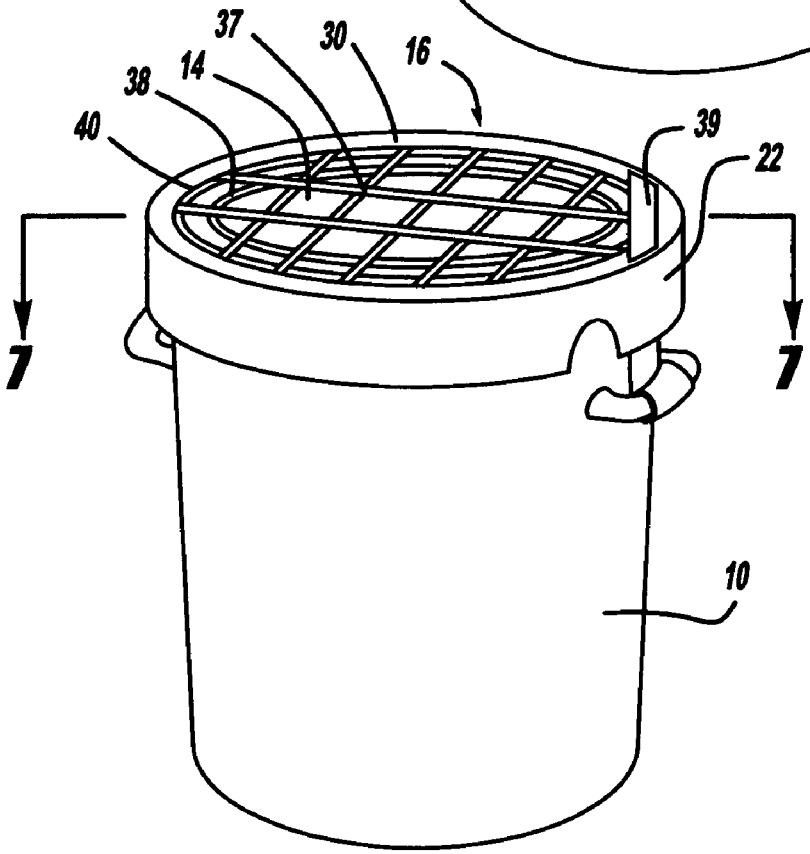
FIG. 6 is a perspective view of a second embodiment of the permeable containment apparatus for a receptacle according to the present invention.

FIG. 6, a second embodiment of the permeable containment apparatus 16 is shown. FIG. 6 shows an integrated permeable containment apparatus 16, with a selectively retractable lid 37. In this embodiment, emptying of the receptacle 10 does not require removal of the permeable containment apparatus 16. The integrated permeable containment apparatus 16 has a hinge 39 that allows the selectively retractable lid 37 to swing open (see FIG. 7*b*) when the receptacle 10 is tipped upside down to empty the refuse from its open end 14. As such, when the receptacle 10 is brought back to its upright position, the selectively retractable lid 37 swings back to a closed position (see FIG. 7*a*), thus ensuring containment of future refuse. The operation of this selectively retractable lid 37 can best be seen in FIGS. 7*a* and 7*b*.

Figure 7A:
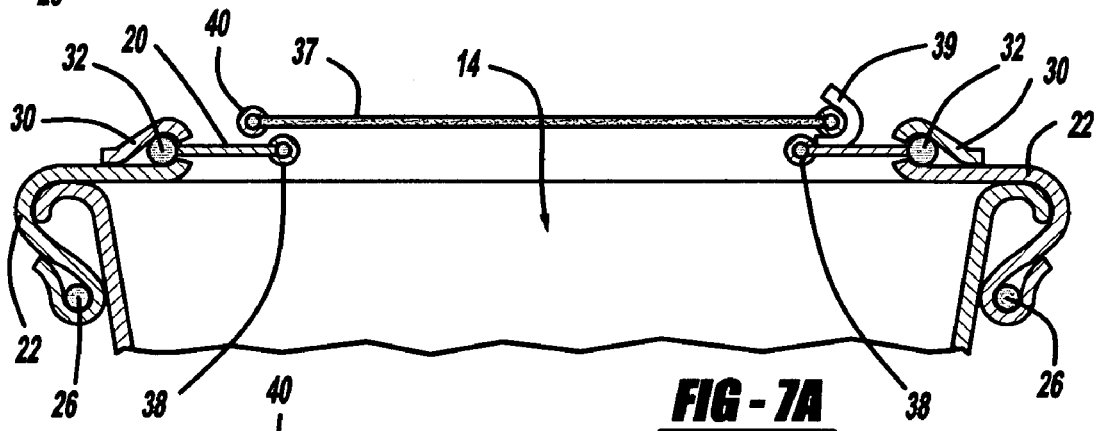
FIG. 7*a* is a cross-sectional view taken along line 7-7 of FIG. 6 of the second embodiment of the permeable containment apparatus for a receptacle according to the present invention.
Figure 7B:
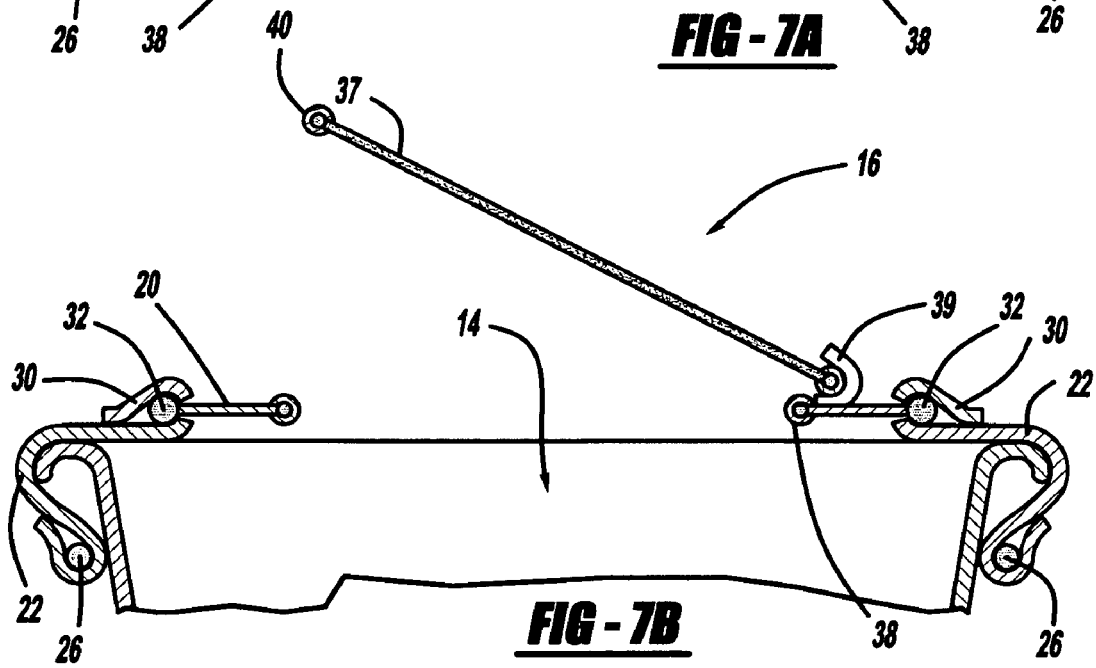
FIG. 7*b* is a cross-sectional view taken along line 7-7 of FIG. 6 of the second embodiment of the permeable containment apparatus for a receptacle in an open position according to the present invention.

A closer look at the second embodiment of the permeable containment apparatus 16 is shown in FIGS. 7*a* and 7*b*. As shown here, the integrated permeable containment apparatus 16 consists of the cover portion 20 coupled with the selectively retractable lid 37 via a hinge 39. The securing portion 22, the edging 30, and the net anchor 32 of the permeable containment apparatus 16 is the same as in the first embodiment. However, the netting or mesh cover portion 20 extends a predetermined distance inward from the net anchor 32 of the edging 30, and terminates at an inner support rim 38. In addition, the hinge 39 rests on the cover portion 20 and is secured to the edging 30 of the securing portion 22 of the permeable containment apparatus 16. As such, it allows the selectively retractable lid 37 to repeatedly open and close.

The selectively retractable lid 37 is attached to the hinge 39, and extends a predetermined distance inward to terminate at a lid perimeter 40. The lid perimeter 40 terminates at a predetermined distance and sufficiently overlaps the inner support rim 38 of the cover portion 20. This allows refuse to be placed into the receptacle 10 through the netting of the cover portion 20 without the selectively retractable lid 37 being a hindrance or falling into the receptacle 10. The selectively retractable lid 37 may be a netting, or mesh as described in the first embodiment.

Figure 8:
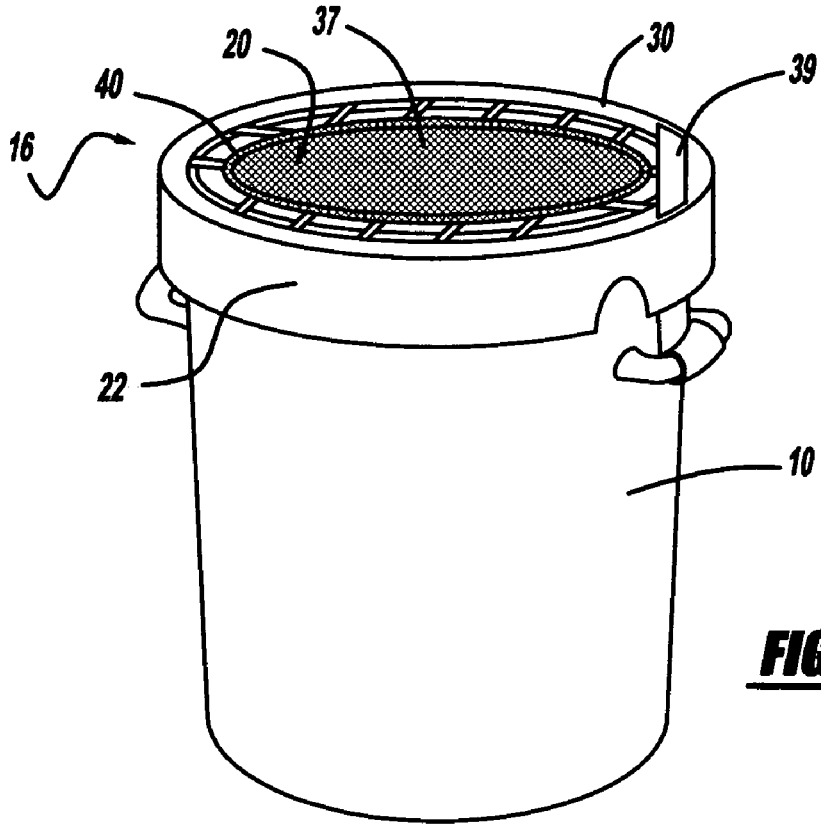
FIG. 8 is a perspective view of a third embodiment of the permeable containment apparatus for a receptacle according to the present invention.
Figure 9:
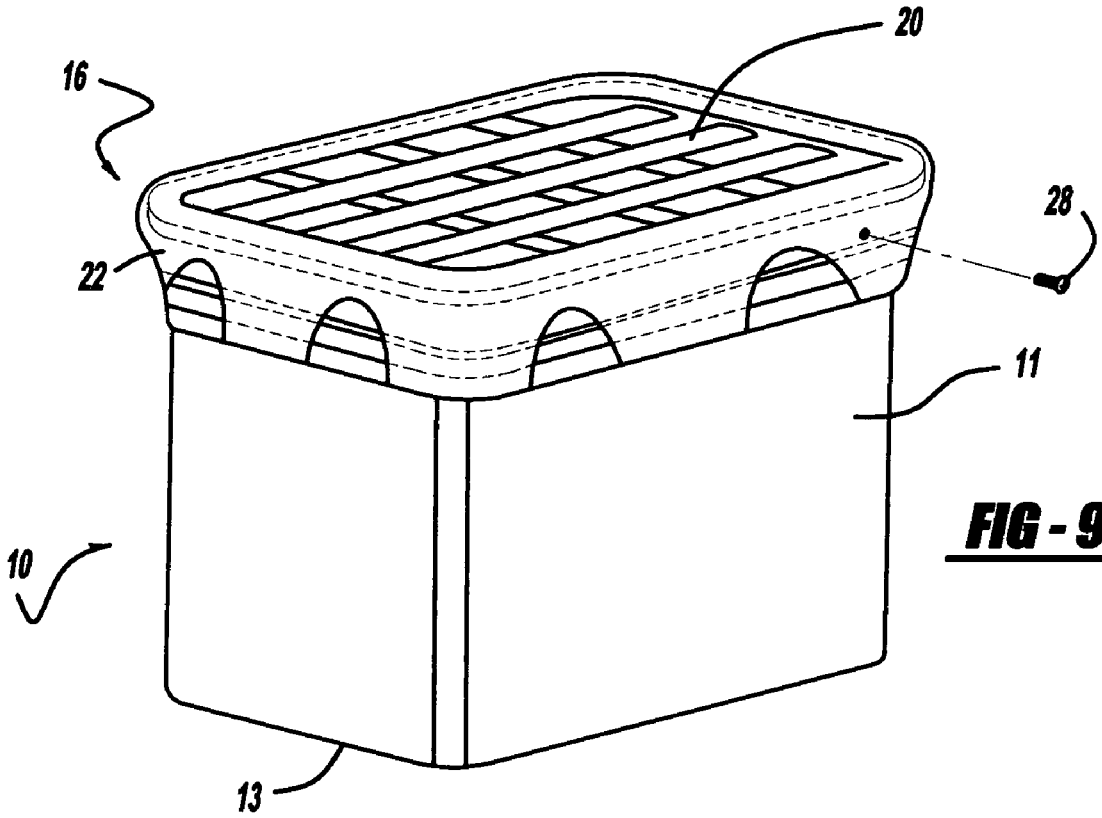
FIG. 9 is a perspective view of the permeable containment apparatus secured to a rectangular receptacle according to the present invention.

A third embodiment of the permeable containment apparatus 16 is shown in FIG. 8. In this embodiment, the same elements apply as in FIG. 6, except the selectively retractable lid 37 is made of a permeable fabric like gore-tex type material, instead of a netting or mesh.

Figure 10:
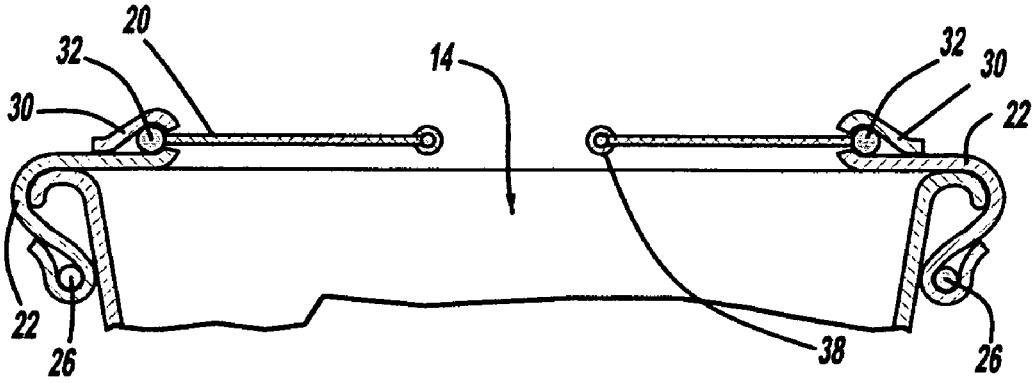
FIG. 10 is a cross-sectional view of FIG. 11 detailing a fourth embodiment of the permeable containment apparatus according to the present invention.
Figure 11:
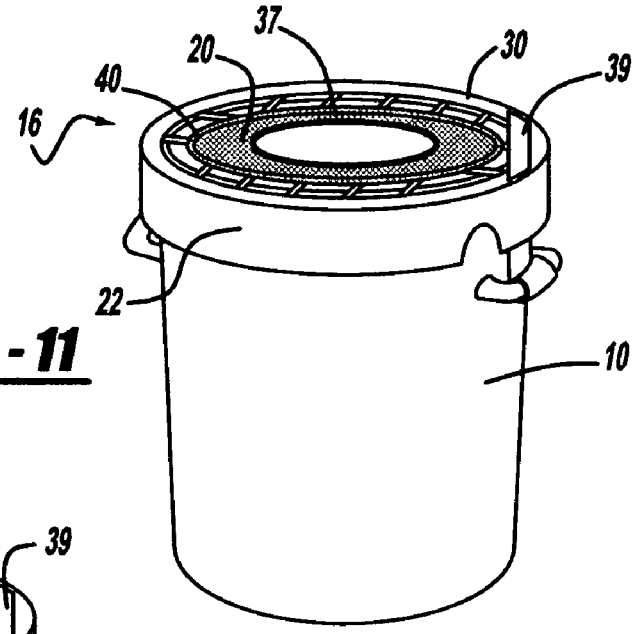
FIG. 11 is a perspective view of a fourth embodiment of the permeable containment apparatus for a receptacle according to the present invention.
Figure 12:
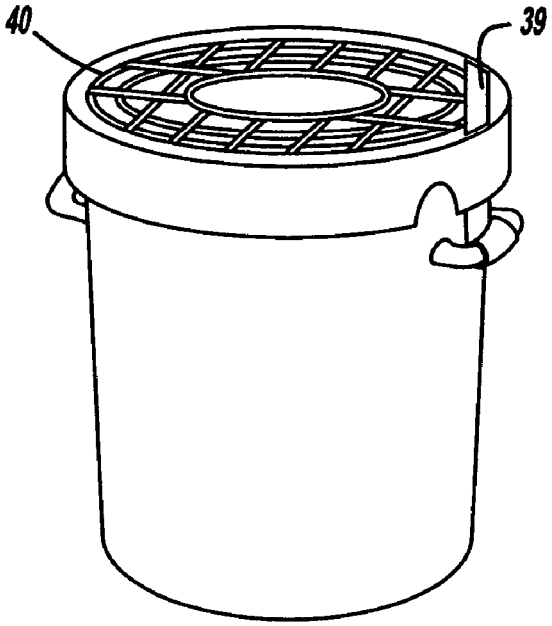
FIG. 12 is a perspective view of a fourth embodiment of the permeable containment apparatus for a receptacle according to the present invention.

In FIGS. 10-12, a fourth embodiment of the permeable containment apparatus 16 is shown. FIG. 11 shows an integrated permeable containment apparatus 16, absent a selectively retractable lid 37, as shown for the second embodiment in FIGS. 7A and 7B. In this embodiment, emptying of the receptacle 10 does not require removal of the permeable containment apparatus 16 as required with the first embodiment, and is easier to use and less cumbersome than the second embodiment. An operator merely needs to invert the receptacle 10 and shake vigorously in order to have individual bottles, cans, and typical recyclable and waste materials, as known by the sanitation and recycling arts, fall free of the receptacle 10 through an open end 14 defined by a support rim 38 of a cover portion 20. Detail of this fourth embodiment for the permeable containment apparatus 16 is shown in FIG. 10.

As shown in FIG. 10, the integrated permeable containment apparatus 16 includes a cover portion 20 operatively attached to a securing portion 22 having an edging 30, a net anchor 32 and an annular biasing mechanism 26, as in the first embodiment. However, the cover portion 20 extends a predetermined distance further inward than the second embodiment, toward a receptacle 10 vertical centerline, from the net anchor 32 of the edging 30, and terminates at an inner support rim 38. This allows recyclables and waste to be placed into the receptacle 10 (or fall out of the receptacle 10 upon inversion) via the open end 14 through the cover portion 20 without having to manage a selectively retractable lid, as described for the second embodiment.

As with the third embodiment of the permeable containment apparatus 16, and as shown in FIG. 8 for said embodiment and further described below, various materials may be interchanged without departing from the scope of the present invention for all embodiments herein. For example, in the fourth embodiment, the cover portion may be a semi-permeable Gore-Tex type material, or a substantially permeable nylon or Lycra type elastic fiber mesh 46 or an interwoven Bungee type elastic cord netting 48, as shown in FIGS. 11 and 12, respectively.

While more than one embodiment of the permeable containment apparatus 16 has been described, still others may be possible without departing from the scope of the following claims.

What is claimed is:

1. A permeable containment apparatus for a receptacle having a vertical containment wall, an open end, and an upper wall region terminating at a peripheral edge, comprising:

a securing portion having an annular biasing mechanism adapted to maintain said securing portion in contacting relationship with the upper wall region of said receptacle;

a substantially permeable cover portion attached to said securing portion and extending a predetermined distance inward from the peripheral edge and terminating at an inner support rim;

a substantially permeable selectively retractable lid hingedly attached to said securing portion and terminating at a lid perimeter;

wherein said permeable selectively retractable lid is operable between an open position and a closed permeable cover portion contacting position; and wherein said permeable cover portion is a mesh netting.

2. The permeable containment apparatus for a receptacle as defined in claim 1, wherein said permeable selectively retractable lid is a gore-tex type breathable fabric.

3. A permeable containment apparatus for a receptacle having a vertical containment wall, an open end, and an upper wall region terminating at a peripheral edge, comprising:

a securing portion having an annular biasing mechanism adapted to maintain said securing portion in contacting relationship with the upper wall region of said receptacle;

a substantially permeable cover portion attached to said securing portion and extending a predetermined distance inward from the peripheral edge and terminating at an inner support rim;

a substantially permeable selectively retractable lid hingedly attached to said securing portion and terminating at a lid perimeter;

wherein said permeable selectively retractable lid is operable between an open position and a closed permeable cover portion contacting position; and wherein said permeable selectively retractable lid is a mish netting.

4. A permeable containment apparatus for a receptacle having a vertical containment wall, an open end, and an upper wall region terminating at a peripheral edge, comprising:

a securing portion having an annular biasing mechanism adapted to maintain said securing portion in contacting relationship with the upper wall region of said receptacle;

a substantially permeable cover portion attached to said securing portion and extending a predetermined distance inward from the peripheral edge and terminating at an inner support rim;

a substantially permeable selectively retractable lid hingedly attached to said securing portion and terminating at a lid perimeter;

wherein said permeable selectively retractable lid is operable between an open position and a closed permeable cover portion contacting position; and wherein the securing portion is a heavy-duty nylon sheath.

* * * * *